United States Patent [19]

Clark

[11] Patent Number: 5,059,436

[45] Date of Patent: Oct. 22, 1991

[54] MICROWAVE INTERACTIVE PACKAGE

[75] Inventor: John F. Clark, Berala, Australia

[73] Assignee: Leigh-Mardon Pty. Limited, Australia

[21] Appl. No.: 455,404

[22] PCT Filed: Jun. 7, 1988

[86] PCT No.: PCT/AU88/00179

§ 371 Date: Jan. 4, 1990

§ 102(e) Date: Jan. 4, 1990

[87] PCT Pub. No.: WO88/09754

PCT Pub. Date: Dec. 15, 1988

[30] Foreign Application Priority Data

Jun. 9, 1987 [AU] Australia ..... PI2360

[51] Int. Cl.[5] ..... B65D 85/00

[52] U.S. Cl. ..... 426/107; 426/113; 426/126; 426/234; 426/243

[58] Field of Search ..... 426/107, 126, 243, 234, 426/113

[56] References Cited

U.S. PATENT DOCUMENTS

| | | | |
|---|---|---|---|
| 2,881,078 | 4/1959 | Oritt | 426/107 |
| 3,615,711 | 10/1971 | Markus et al. | 426/107 |
| 4,122,324 | 10/1978 | Falk | 426/237 |
| 4,190,757 | 2/1980 | Turpin et al. | 426/107 |
| 4,230,924 | 10/1980 | Brastad et al. | 426/107 |
| 4,267,420 | 5/1981 | Brastad | 426/107 |
| 4,351,997 | 9/1982 | Mattisson et al. | 426/107 |
| 4,363,851 | 12/1982 | Mishina et al. | 426/126 |
| 4,590,349 | 5/1986 | Brown et al. | 426/243 |
| 4,592,914 | 6/1986 | Kuchenbecker | 426/113 |
| 4,594,492 | 6/1986 | Maroszek | 426/243 |
| 4,626,641 | 12/1986 | Brown | 426/243 |
| 4,641,005 | 2/1987 | Seiferth | 426/107 |
| 4,735,513 | 4/1988 | Watkins et al. | 426/107 |
| 4,742,203 | 5/1988 | Brown et al. | 426/243 |
| 4,890,439 | 1/1990 | Smart et al. | 426/124 |

FOREIGN PATENT DOCUMENTS

| | | | |
|---|---|---|---|
| 0063108 | 10/1982 | European Pat. Off. . | |
| 0240571 | 10/1987 | European Pat. Off. . | |
| 2362769 | 3/1978 | France | 229/10.55 E |
| 504361 | 3/1971 | Switzerland . | |

*Primary Examiner*—Donald E. Czaja
*Assistant Examiner*—Jean L. Aberle
*Attorney, Agent, or Firm*—Oliff & Berridge

[57] ABSTRACT

A package for heating food in a microwave oven includes at least one web which is a laminate comprising a dielectric layer (1), a microwave interactive layer (2) a structural layer (4). The package has a package seam (14) wherein at least one thickness of the, or another web, is joined with a second thickness.

20 Claims, 1 Drawing Sheet

MICROWAVE INTERACTIVE PACKAGE

FIELD OF THE INVENTION

This invention relates to packaging and more particularly to packaging which facilitates microwave heating of certain foodstuffs.

The invention will herein be described with reference to packaging for pies but it will be understood that the invention is useful for packaging a variety of pastry products and other foodstuffs and is not limited to use with any particular food.

BACKGROUND ART

Meat pies have hitherto been packaged in paper bags or in individual transparent film packs manufactured by folded web packaging machinery. When it is desired to heat a pie it is removed from the package and placed in an oven. However if heated in a microwave oven the pie filling tends to become excessively hot and/or the pastry tends to become soggy during heating. It has been suggested to avoid or lessen this problem by heating the pastry in contact with a microwave interactive surface, which browns or toasts the pastry surface.

Some microwave interactive surfaces form part of a utensil which needs to be washed after use. Brastad (U.S. Pat. No. 4,267,420) described a disposable microwave interactive plastic film for wrapping crumbed fish piece and the like. We have found that the Brastad wrapping has a tendency to overheat, shrink and even melt in regions which are subjected to microwave energy while not in contact with the wrapped foodstuff, especially when the film is in overlapping layers each of which is heated by microwaves.

Moreover some pastry products become soggy if heated with all surfaces in contact with a plastic film without air circulation.

Other microwave interactive materials have been employed for example as a thin flat tray or sheet in the base of a carton. In that case overlapping thicknesses of microwave interactive layers are avoided and air circulation is permitted resulting in a crisp pastry. However cartons are a relatively expensive means of packaging and have other well know disadvantages.

An object of the present invention is the provision of a package in which a pie pastry product or the like may be handled in commerce, which facilitates heating of the content in a microwave oven, and which avoids or ameliorates at least some of the disadvantages of prior art.

DISCLOSURE OF THE INVENTION

According to one aspect the invention consists in a package for heating contained food in a microwave oven said package comprising:

at least one web; a package seam wherein at least one thickness of the web is affixed to a second thickness of the, or another, web in overlapping or overlying relationship; and wherein the web or webs of the seam comprise a dielectric layer, a microwave interactive layer adapted for heating the contained food when subjected to microwave energy and a structural layer.

Preferred embodiments of the invention are paper bags or folded web packages manufactured on conventional machinery utilizing a laminate in which the dielectric layer is a polyester film, the microwave interactive layer is a vacuum deposited thin layer of aluminium and the structural layer is paper. The metallized polyester is adhesively laminated to the paper. In the preferred embodiment the polyester layer is provided with an amorphous surface layer or face and seams are formed by heat sealing the polyester face of one seam web to the polyester face of the other seam web.

It is surprising that a bag of this construction can be heated in a microwave oven without excessive temperature build up at a seam and at parts of the package not in contact with food and indeed that the two sides of the seam remain adhered one to the other after microwave heating.

BRIEF DESCRIPTION OF THE DRAWINGS

The invention will now be more particularly described with reference to particular embodiments by way of example only with reference to the accompanying drawings wherein.

PREFERRED EMBODIMENTS OF THE INVENTION

Figure 1:
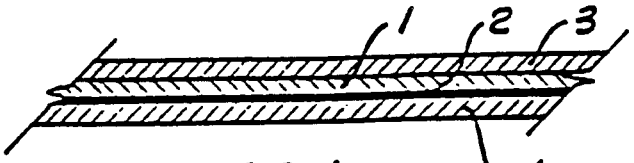
FIG. 1 shows a laminate according to the invention (not to scale).

With reference to FIG. 1 there is illustrated a laminate or web comprising a dielectric film 1 for example polyester, Mylar*, Melinex* or the like. Film 1 is provided with a microwave interactive layer 2 which is preferably a vacuum deposited layer of aluminium metal having a thickness of less than about 700 angstroms but which in other embodiments may be a metal oxide coating or may be a different metal for example, copper, or silver, or may be an organic or inorganic conductor or semiconductor or microwave susceptible paint. Dielectric film 1 acts as a carrier or support for interactive layer 2.

*Registered Trade Mark

The side of dielectric film 1 opposite microwave interactive layer 2 is provided with a heat sealable surface 3 the purpose of which is to enable the web to be joined at seams.

In the case in which film 2 is polyester the film may be treated to provide a heat sealable amorphous polyester surface and there will be no distinct interface between layers 1 and 3.

However a heat sealable layer may be provided by chemical or physical treatment of the surface of film or by lamination, coating or coextrusion of a thermoplastic layer to the metallized dielectric or the dielectric film may itself be a fuseable thermoplastic. In the preferred embodiment the dielectric film 1 is Melinx 850 which is a polyester film coextruded with a heat sealable coextrudate. A heat sealable face exhibiting bonding capable of withstanding high temperature and known as having a high "hot tack" is strongly preferred. Another high "hot tack" coating is a polyvinylidene chloride copolymer.

The laminate is provided with a structural layer 4 which in the preferred embodiment is bonded by an adhesive (not illustrated) to the metallized coating 2 of film 1.

The structural layer is preferably a kraft paper but may be paper manufactured by other processes or may be a cellulose web or paperboard. In yet other embodiments the structural layers may include other synthetic or natural fibres or may be a polymer film or other layer giving adequate strength to the package to permit its use in storage and commerce.

The adhesive by means of which the structural layer is bonded to the metallized polyester is desirably a temperature resistant adhesive which is satisfactory for use in proximity to foodstuffs, for example neoprene or a like synthetic rubber, or a vinyl compound such as polyvinyl acetate or ethylvinylacetate.

Figure 2:
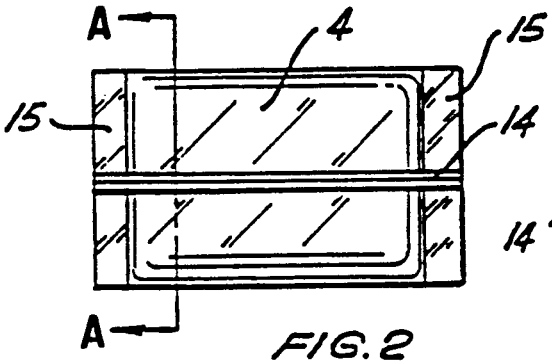
FIG. 2 shows a package according to the invention.
Figure 3:
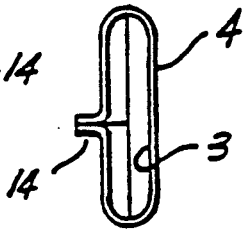
FIG. 3 shows the package of FIG. 2 in end view when viewed on line A—A.

A bag according to the invention is shown in FIGS. 2 and 3. The bag may be made by feeding as a web a laminate such as described above to a conventional folded web packaging machine. By way of example, the machine first forms a tubular shape having the polyester side on the interior and the paper side 4 on the exterior of the tube. A seam 14 is formed from the side margins of the laminate which are mated face 3 to face 3 and heat sealed, the resulting seam 14 then being folded flat against the package surface. Although seam 14 is shown in the drawing as upstanding rather than flat for clarity of explanation it will be appreciated that when folded flat three layers of web are overlapping each other on seam 14 except at the ends where four layers are then overlapping. Seam 14 extends in the tube axial direction. The tube is then compressed transverse the tube axial direction and the upper tube wall is sealed to the lower tube wall to form a transverse or end seal 15.

If a food package is being formed a food item 16 may be placed on the sheet prior to folding into tubular form and the package will be sealed at both ends 15, each transverse end seal 15 being guillotined along the seam centerline in the transverse direction to sever one package from another.

It will be understood that in common practice food items may be packaged in folded web machine the package being sealed at both ends. While it is not usual to manufacture bags on such machines, bags may be made by guillotining the folded web package intermediate end seals to provide a bag open at one end and into which foodstuffs may be placed subsequently. The seals may be formed by use of adhesives, and may be additionally crimped or folded.

The mechanism of the invention is not clearly understood but it appears that the paper layer is able to conduct heat away from the seam overlap at a sufficient rate to prevent excessive heat build up and to conduct the heat to the foodstuff which acts as a heat sink or at any rate to distribute heat more uniformly while maintaining the dimensional integrity of the package during heating.

It is surprising that the seams remain intact. It would be expected that during microwave heating the temperature between overlapping layers would reach around 200° C. and would easily exceed the softening temperature of a heat seal. Having regard to pressure build up in a sealed bag or other tensions caused by heating, it would be thought the seal would rupture. It is believed that in preferred embodiments of the invention the amorphous polyester softens during microwave heating at the seams where it is sandwiched between two metal layers but the "hot tack" of the adhesive is sufficiently high to overcome any tendency for the seam to open and/or reseals the bag when the oven is deenergized.

In use a pastry type food item for example a meat pie, sausage roll, pizza or the like contained within a sealed bag may be heated in a microwave oven. The bag expands as the air in the bag becomes heated but surprisingly the pastry is crisped and the seams remain intact.

The foodstuff need not be heated in the receptacle while sealed and instead one or both ends of the package may be open during microwave heating thereby to vent the receptacle. For example the sealed ends may be severed from the package or a thermoplastic adhesive having poor "hot tack" can be employed at one or both ends so that the package is self opening at that, or those ends during microwave heating. In that case the foodstuff in the resulting open ended tube is placed in a microwave oven which is then energized.

Figure 4:
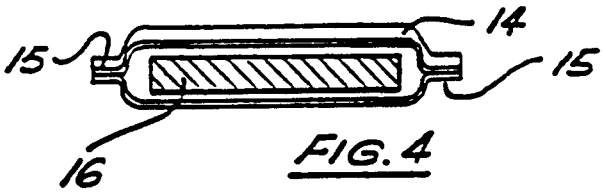
FIG. 4 shows in cross section a package according to the invention containing a food item.
Figure 6:
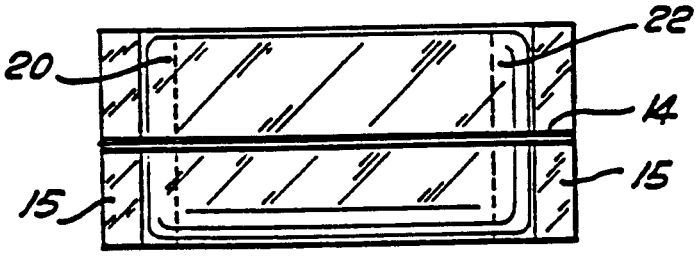
FIG. 6 shows a second embodiment of the invention.
Figure 5:
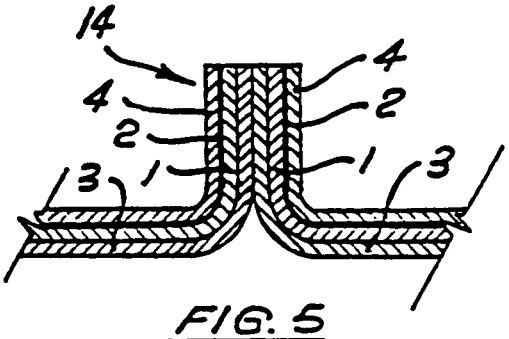
FIG. 5 shows an enlargement of a seam of the package.

Another embodiment of the invention is shown in FIG. 6. A package containing a food item and similar to that of FIG. 4 is provided with severence means 20 which enable an end seam 15 to be removed from the package. For preference the severence means consists in a line of closely spaced perforations 20 extending adjacent to end seam 15 and circumnavigating the tube. A second line 22 of perforations circumnavigates the tube adjacent the opposite end seam 15.

The perforations are of a microfine nature and facilitate separation of the end margin seal from the remainder of the package. Removal of both end margins permits air to circulate into or through the package during heating as is desirable for some pastry products.

In use of the embodiment of FIG. 6 one or both end seams 15 are first torn from the package The open ended package enclosing the pastry food is then placed in a microwave oven which is then energized to heat the content and crisp the pastry in contact with the laminate.

The heated food is subsequently removed from the package.

Other severence means which can be used include tear strips, or threads or other means of forming a line of weakness. If perforations are used it is not essential that they extend around the whole packet. It is sufficient that the packet is weakened sufficiently to facilitate removal of the end strip by tearing.

As will be apparent to those skilled in the art from the teaching thereof the invention may be embodied in other forms without departing from the scope thereof.

I claim:

1. A package for heating contained food in a microwave oven, said package comprising:

at least one web;

a packaging seam wherein at least one thickness of the web is affixed to a second thickness of the, or another, web in overlapping relationship;

and wherein the web or each web of the seam comprises:

a dielectric layer, a microwave interactive layer comprising a microwave susceptible material which allows microwaves to pass therethrough but which also interacts with a proportion of the incident microwave energy and converts the same to heat energy, said microwave interactive layer being of a thickness of 700Å or less and being heated to a temperature of about 200° C. when subjected to microwave energy for conductively heating the contained food, and a structural layer made from paper which maintains the dimensional integrity of the package when said microwave interactive layer is heated.

2. A package according to claim 1 wherein the dielectric layer comprises a polyester film.

3. A package according to claim 1 formed by means of folded web packaging machine.

4. A package according to claim 1 in the form of a bag having an open end, a seam closing an opposite end and a seam extending from the open end to the opposite end.

5. A package according to claim 4 wherein the seam closing said opposite end is folded.

6. A package according to claim 1 in the form of a bag having a foodstuff sealed therein and having two ends each closed by a seam and having a seam extending from one end to the other end.

7. A package according to claim 1 wherein a seam includes one web portion joined to another by a heat seal exhibiting a high hot tack.

8. A package according to claim 1 wherein the dielectric layer is or includes a heat sealable thermoplastic.

9. A package according to claim 1 wherein the dielectric layer is a polyester having a heat sealable, high hot tack, amorphous polyester surface.

10. A package according to claim 1 wherein the structural layer is on the exterior side of the package.

11. A package according to claim 1 comprising severence means integral with the package for facilitating separation of a seam from the package.

12. A package according to claim 11 wherein the severence means consists in a plurality of microperforations extending along a line adjacent the seam.

13. A package according to claim 11 wherein the package is tubular and has a seam extending in the tube axial direction and has spaced apart seams extending transverse the axial direction, each of said transverse seams having severence means whereby each transverse seam may be removed.

14. A package according to claim 1 containing a foodstuff including a pastry surface.

15. (Twice amended) A method for heating a foodstuff contained in a package according to claim 1, said package having end seams at or adjacent opposite ends of the package, said method comprising the steps of (1) removing each of said end seams to form a hollow tube having open ends and surrounding the food, and (2) placing the tube containing the food in a microwave field.

16. A method for heating a foodstuff contained in a package according to claim 11 comprising the steps of (1) separating both end seams from the package (2) placing the package containing the foodstuff in a microwave oven, and (3) energizing the oven.

17. A package according to claim 1, wherein the webs of the seam are affixed to each other such that the entire structural layer is on an exterior side of the package.

18. A package for heating and browning contained food in a microwave oven, said package comprising:

at least one web;

a packaging seam wherein at least one thickness of the web is affixed to a second thickness of the, or another, web in overlapping relationship;

and wherein the web or each web of the seam comprises:

a dielectric layer, a microwave interactive layer comprising a microwave susceptible metal material which allows microwaves to pass therethrough but which also interacts with a proportion of the incident microwave energy and converts the proportion of the incedent microwave energy to heat energy, said microwave interactive layer having a thickness of 700Å or less and being heated to a temperature of about 200° C. when subjected to microwave energy for conductively heating the contained food, and a structural layer made from paper which maintains the dimensional integrity of the package when said microwave interactive layer is heated.

19. The package of claim 18, wherein said metal material is aluminum.

20. A package for heating contained food in a microwave oven, said package comprising:

at least one web;

a packaging seam wherein at least one thickness of the web is affixed to a second thickness of the, or another, web in overlapping relationship by a hot tack adhesive;

and wherein the web or each web of the seam comprises:

a dielectric layer, a microwave interactive layer comprising a microwave susceptible material which allows microwaves to pass therethrough but which also interacts with a proportion of the incident microwave energy and converts the proportion of the incedent microwave energy to heat energy, said microwave interactive layer having a thickness of 700Å or less and being heated to a temperature of about 200° C. when subjected to microwave energy for conductively heating the contained food, and a structural layer made from paper which maintains the dimensional integrity of the package when said microwave interactive layer is heated;

wherein said package, when sealed, can be heated from ambient temperature to substantially 200° C. without said seam separating.

* * * * *